US006792854B2

(12) United States Patent
Tafel

(10) Patent No.: US 6,792,854 B2
(45) Date of Patent: Sep. 21, 2004

(54) DIGITAL LIQUID DISPENSER

(76) Inventor: Leonard I. Tafel, 1821 Azalea La., Mt. Prospect, IL (US) 60056

( * ) Notice: Subject to any disclaimer, the term of this patent is extended or adjusted under 35 U.S.C. 154(b) by 0 days.

(21) Appl. No.: 10/314,582

(22) Filed: Dec. 9, 2002

(65) Prior Publication Data

US 2004/0107852 A1 Jun. 10, 2004

(51) Int. Cl.[7] ..... B41F 31/00

(52) U.S. Cl. ..... 101/350.1; 101/363

(58) Field of Search ..... 101/349.1, 49, 101/350.1, 363–366, 206–208, 348

(56) References Cited

U.S. PATENT DOCUMENTS

| | | | | | |
|---|---|---|---|---|---|
| 4,092,922 | A | * | 6/1978 | Schweitzer | 101/363 |
| 5,239,925 | A | * | 8/1993 | Bobo | 101/366 |
| 5,878,667 | A | * | 3/1999 | Ryan | 101/366 |
| 5,957,051 | A | * | 9/1999 | Atwater | 101/366 |
| 6,085,652 | A | * | 7/2000 | Deschner et al. | 101/366 |

* cited by examiner

*Primary Examiner*—Minh H Chau

(57) ABSTRACT

An economical liquid metering device which dispenses liquid in digital steps. Further advantages are: the ease of liquid change because components which are in contact with the liquid are economically exchangeable or disposable, and each computer pulse dispenses a predictable quantity of the liquid. To provide a continuous flow, the volume and operation rate between pump pulses may be controlled, so that the dispensing rate becomes substantially continuous.

6 Claims, 7 Drawing Sheets

DIGITAL LIQUID DISPENSER

DESCRIPTION OF RELATED ART

The most commonly used means for regulating the supply of ink across the width of a printing press has been the use of a doctor blade acting against a rotating "fountain roller", which is driven by the press, either with gears or ratchets. The roller and doctor blade form a trough filled with ink, with an adjustable width slit near the bottom and sealing devices at the ends. Additional mechanism must be provided to transfer the ink from the slow-speed fountain roller to the high-speed inking rollers which are transferring ink to the printing plate. The RPM of these inking rollers is in the range of 1500 RPM per minute, while the fountain roller operates at around 10 RPM. One such way of matching the speeds is a "ductor roller" which alternately contacts the slow fountain roller and then contacts, and immediately is accelerated by, the high-speed ink rollers. This acceleration and deceleration severely impacts the press components. Another system uses a high-speed knurled inker roller, which is closely spaced to the fountain roller. This knurled roller "skims-off" ink on the fountain roller above a certain thickness. These systems are seriously affected by the temperatures of the ink and the press components, by the press speed and by the length of time the press has been running, by wear, by adjustment of the rollers, and by ink rheoscopic variables, among many other things.

Some presses utilize specially designed variable-volume ink pumps. The pump modules are usually in a row across the press, each pump module serving between an inch, and inch-and-a-half of web width.

Ink is a very abrasive liquid which wears-out machine sliding elements such as pistons and valves, and the ink dries hard when exposed to air, adhering mechanisms together. Also, these pumps are expensive, difficult to clean, require maintenance, deviate from set volume, and have many expensive wearing parts which gradually deteriorate over the life of the device, causing leakage and inaccurate control. These drawbacks and other have prevented existing ink pump designs from being widely adopted.

Examples of such prior art are listed:

The Reed U.S. Pat. No. 2,866,411 teaches a central group of variable stroke piston pumps connected by tubes to an ink rail. Distancing the pump from the roller onto which the ink will be dispensed increases cleaning problems.

The Hegeman U.S. Pat. No. 3,018,727 teaches a piston pump with sliding vales. Sliding surfaces immersed in abrasive ink will wear and leak rapidly.

The Fusco U.S. Pat. No. 3,366,051 teaches the use of a plurality of rotary axial-piston variable-volume ink pumps with improved drive.

The Noon U.S. Pat. No. 3,298,305 pumps a steady stream of ink onto a roller. There is a lot of exposure to air and other contaminants.

The Braun U.S. Pat. No. 4,332,196 teaches the use of a series of slide valves which regulate ink volume by timing the "on" position.

The Bryer U.S. Pat. No. 4,020,760 teaches the use of a variable stroke axial piston pump with a screw acting against a spring to vary the allowable stroke of the piston. There are many parts in this patent that will wear and leak.

The Niemiro U.S. Pat. No. 5,027,706 teaches a time-opening rapidly acting ink valve The varying rheoscopic properties of ink make control in this manner subject to volumetric variations.

The Nikkamen U.S. Pat. No. 5,405,252 teaches the use of a complex diaphragm pump.

The Uera U.S. Pat. No. 5,526,745 teaches a piston pump driven by a stepping motor. This device has many working parts exposed to the abrasiveness of ink.

The Kirihara U.S. Pat. No. 5,575,208 teaches a microprocessor controlled, motor driven, piston type ink pump.

The Ryan U.S. Pat. No. 5,878,667 uses variable ink pressure to control the amount of ink dispensed, which will cause variations in the dispensing rate depending on the temperature and viscosity oif the ink. No provision is shown for regulating the amount of ink dispensed across the width of a roller.

The Atwater U.S. Pat. No. 5,957,051 teaches microprocessor controlled, motor driven, piston type ink pumps which each employ a moving combination piston and rotary valve injector with precision fitted sliding and rotating elements immersed in the abrasive ink; leakage from wear, both internally and externally will occur with use. A blade maintained at a fixed distance from the ink fountain roll serves to spread the ink only if a relatively large amount of ink is being dispensed. Otherwise, only a narrow stream of ink will be applied to the fountain roll. This type of arrangement requires a speed matching arrangement, such as the "micrometric roller which may contain a knurled surface" mentioned in this patent, which is known to introduce variations in the ink transfer, and to be subject to wear.

The Deschner U.S. Pat. No. 6,085,652 teaches a means of supplying ink to an ink fountain in order to maintain a level of ink in the reservoir, either by a stream of ink falling directly into the reservoir, or onto a slow-moving ink fountain roller which then rotates and moves the ink into the reservoir. A conventional doctor blade controls the thickness of the ink film remaining on the fountain roller which is then transferred to the press by a conventional "ductor roller" of a "micrometric roller".

Kawata U.S. Pat. No. 6,336,405 teaches yet another variable volume piston pump with moving parts immersed in the abrasive ink.

SUMMARY OF THE INVENTION

The present system discloses a digital liquid metering pump wherein the liquid is dispensed responsive to a digital signal or group of signals from a computer, such that the pump output is essentially continuous, and virtually all components in contact with the liquid are disposable.

DETAILED DESCRIPTION OF THE INVENTION

Figure 1:
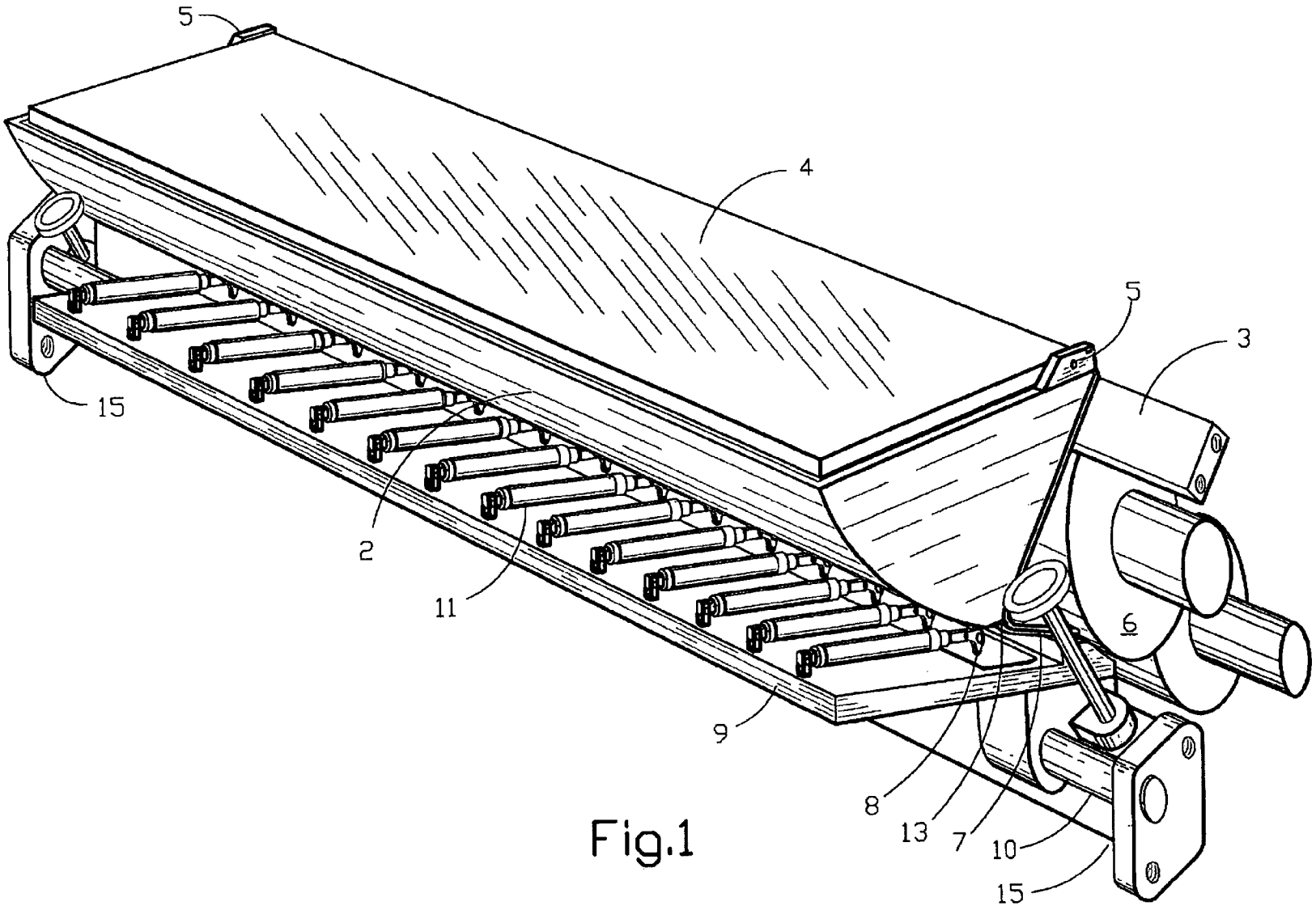
FIG. 1 is a pictorial view showing a linear pneumatic parastaltic pump with the tubing enclosure in the closed and operating position.

While peristaltic pumps are known, the present system drives them, and configures them, in conjunction with other novel entities into an improved, digitally controlled system especially applicable to Graphic arts. Although the descriptions and illustrations refer to a printing press and the application of ink, the present method and apparatus will be understood to apply to various applications, and liquids of various compositions. Referring now specifically to the drawings:

FIG. 1 shows the preferred embodiment in accordance with the present invention, with the pneumatic cylinder 11 retracted. The illustrated system meters printing inks contained in a flexible pressurized reservoir 1 (see FIG. 2) supported by chamber walls 2 and forcibly contained by a pressure plate 4 hinged about pins 5, said chamber walls being supported by a crossbrace 3. Ink in said reservoir is dispensed onto a printing press roller 6 through flexible tubes 7 by peristaltic action of rollers 8, said rollers being forcibly supported in a bracket 16 by wheels 20 and urged against said tubes by a support plate 9 rotatably supported about pin 10. Each of said rollers is caused to reciprocate in a substantially linear path driven by its associated pneumatic cylinder 11 controlled by an individual, commercially available pneumatic valve for each of said cylinders, each of said valves being activated by signals from a computer control means (not shown).

Figure 10:
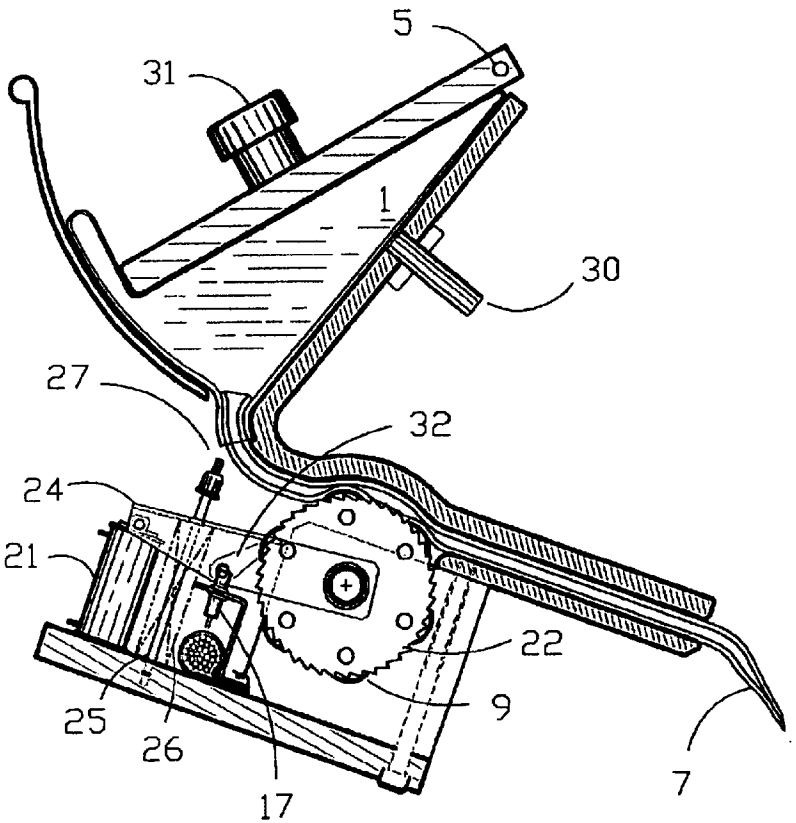
FIG. 10 is a view of FIG. 9, with the solenoid shown energized.

The cover 4 is a pressure plate that is caused to press against the reservoir to provide an equal ink pressure to all the pumps by its own weight and optionally, by an operative means such as a spring or pneumatic device. Proximity sensor 40 indicates to the control system when the reservoir 1 is substantially depleted and alerts the operator. Said reservoir is manually filled through capped opening 28 by the operator, or by an automatic filling means, such as a hose from a central tank with a valve connected to said opening, said valve being opened to permit liquid from said central tank to enter said reservoir by a signal from sensor 25 upon partial depletion of said reservoir, as shown in FIG. 10.

Figure 2:
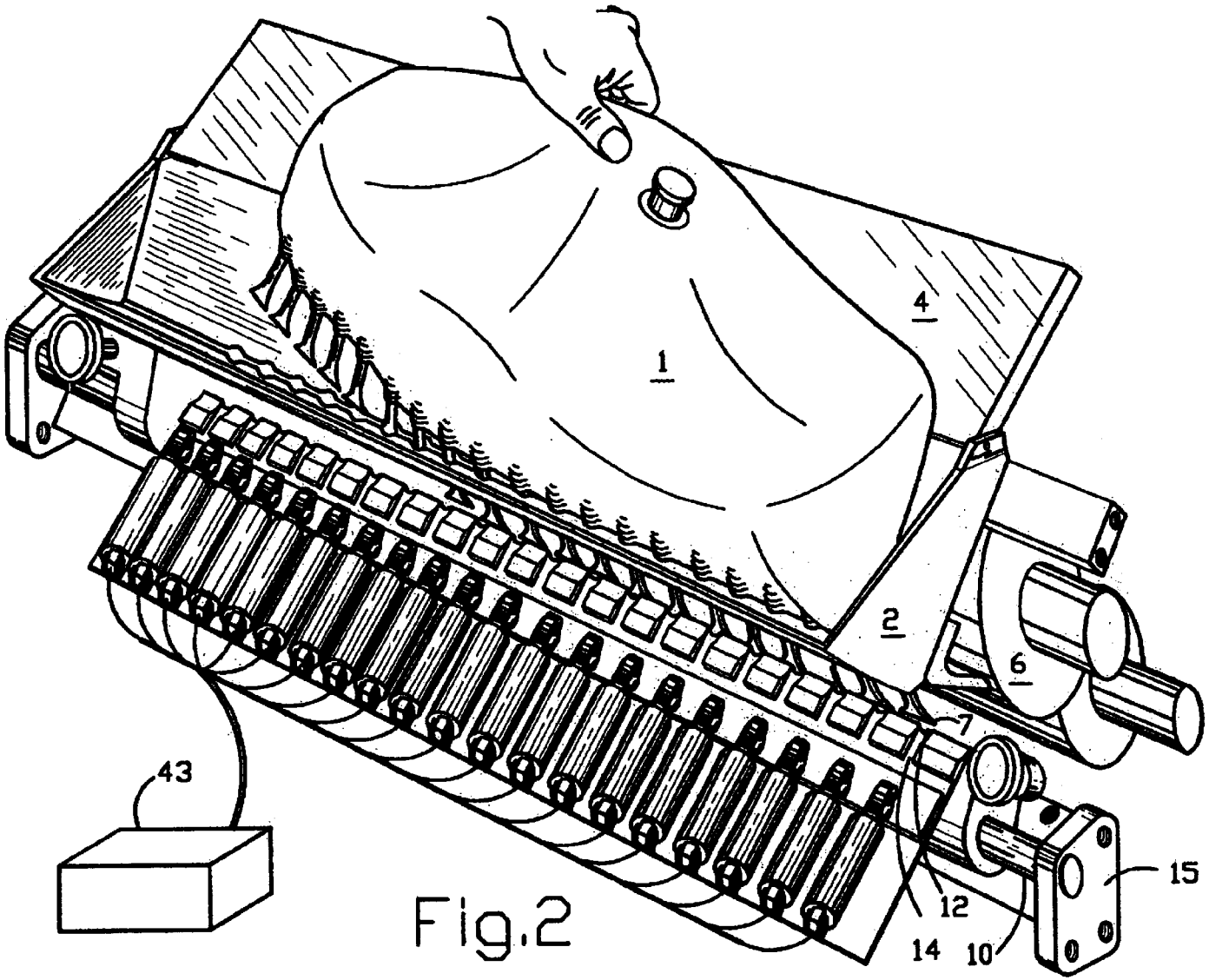
FIG. 2 is a pictorial view showing a linear pneumatic parastaltic pump with the tubing enclosure in its open, loading position, so the ink container and its tubes may be easily inserted.

FIG. 2 is a pictorial view showing FIG. 1 with a support plate 9 and its attached mechanisms rotated about a pivot 10 into a open, loading position and showing the reservoir 1 being inserted and supported by reservoir chamber walls 2 with its dependent hoses 7 protruding downward through a slotted opening 13 in the bottom of said walls. The hoses are positioned such that when said support plate is rotated upwards into the running position about pivot 10 which is rotatably mounted in crossbrace 15, the tapered grooves 12, and the slots 14 in support plate 9 forcibly position said hoses centrally above the rollers 8. Computer 43 supplies a pneumatic signal to each cylinder.

Figure 3:
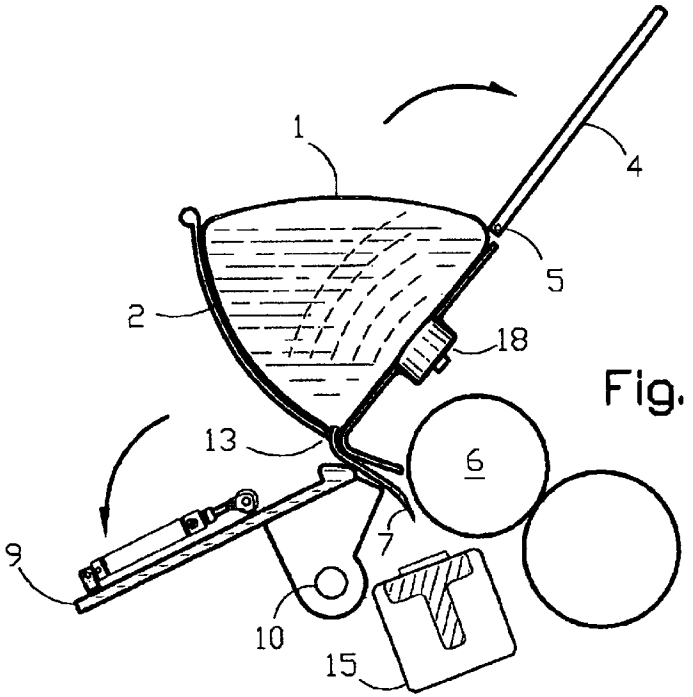
FIG. 3 is a cross-section of FIG. 2 with lower assembly rotated down into the loading position.
Figure 6:
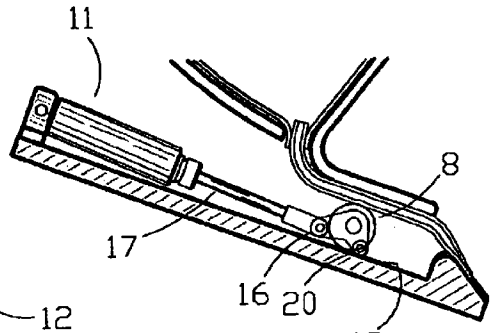
FIG. 6 is a cross-sectional view with the roller assembly in the process of being retracted.
Figure 5:
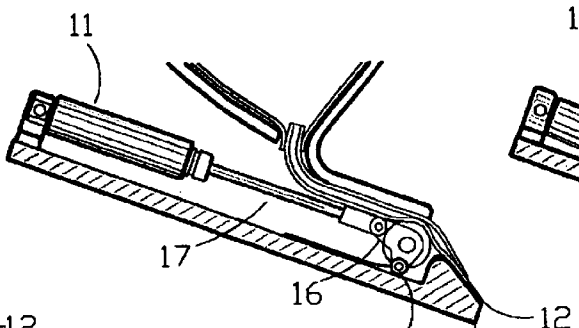
FIG. 5 is a cross-sectional view with cylinder extended and the roller assembly at its extreme forward position.
Figure 4:
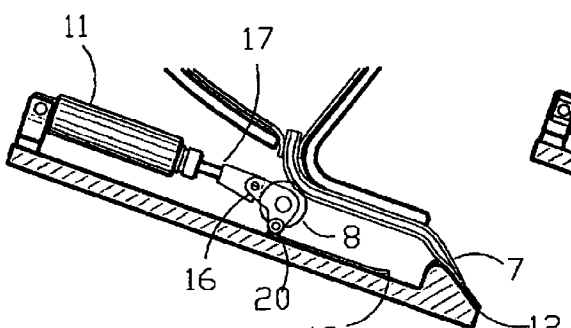
FIG. 4 is a cross-sectional view with the roller assembly fully retracted.

FIG. 3 is a cross-section of FIG. 2 showing hoses 7 protruding downward from reservoir 1 through slotted openings 13 which are shown in more detail in FIGS. 4–6. For very viscous liquids, a plurality of computer-controlled combination heater-vibrators 18 are spaced along the flat surface of wall 2 to improve fluid-flow by lowering apparent-viscosity.

FIG. 4 is a cross-sectional view of FIG. 1 with the roller 8, rotatably supported in bracket 16 at the beginning of a dispensing stroke, and with the pneumatic-cylinder 11, and the cylinder-rod and rod-end assembly 17 fully retracted at the beginning of a dispensing stroke.

FIG. 5 shows cylinder 11, rod-assy. 17, bracket 16 and roller 8 at the end of a dispensing stroke, with support wheel 20 just past the bent up end of flat spring 19.

FIG. 6 shows the return stroke of said pneumatic cylinder, flat spring 19 causing bracket 16 to rotate counter-clockwise sufficiently to move roller 8 towards support plate 9 thereby substantially removing pressure from tube 7, and preventing the roller from moving the liquid contained in the tube in a retrograde direction.

Figure 7:
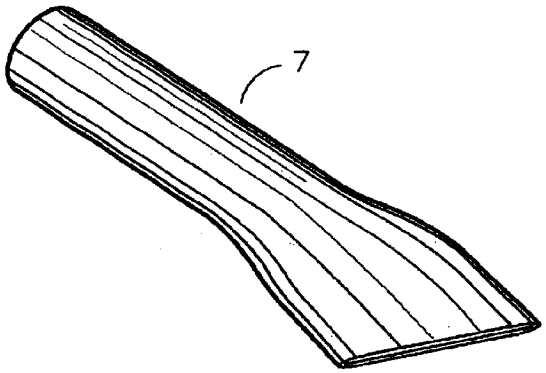
FIG. 7 shows flared and formed tubing ends which serve to distribute the ink along the length of the roller and close together, excluding air and contaminants and preventing dripping.

FIG. 7 is a pictorial view of a representative length of a dispensing end of the tubes, showing the flared and flattened ends of flexible tubes 7 being slightly bent down. This shape acts as a dispensing means by spreading the ink along the length of a roller, acts as a valve to prevent dripping and retrograde movement of the liquid being dispensed.

Figure 8:
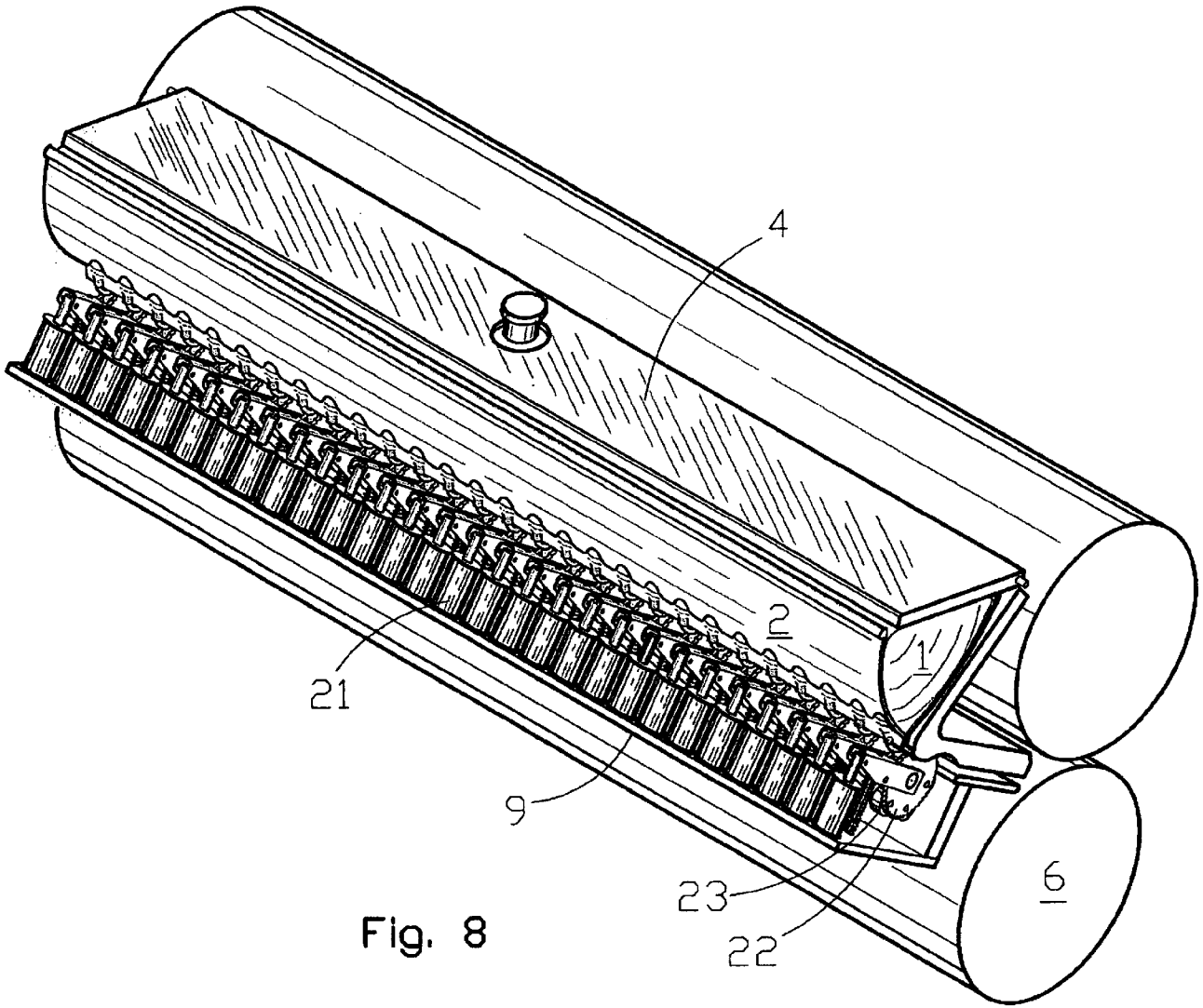
FIG. 8 is a pictorial view of the invention in an alternate embodiment showing a solenoid and ratchet driven rotary peristaltic pump.

FIG. 8 shows a pictorial view of an alternate embodiment in the running position wherein the rollers 23 which act peristaltically on the tubes, move in a circular path, rather than a linear path. The rollers are driven by operative device 21 fastened to support plate 9 and acting through a ratchet 22 or a unidirectional clutch, so disposed that said rollers move in only one direction, which in the present view, is clockwise.

Figure 9:
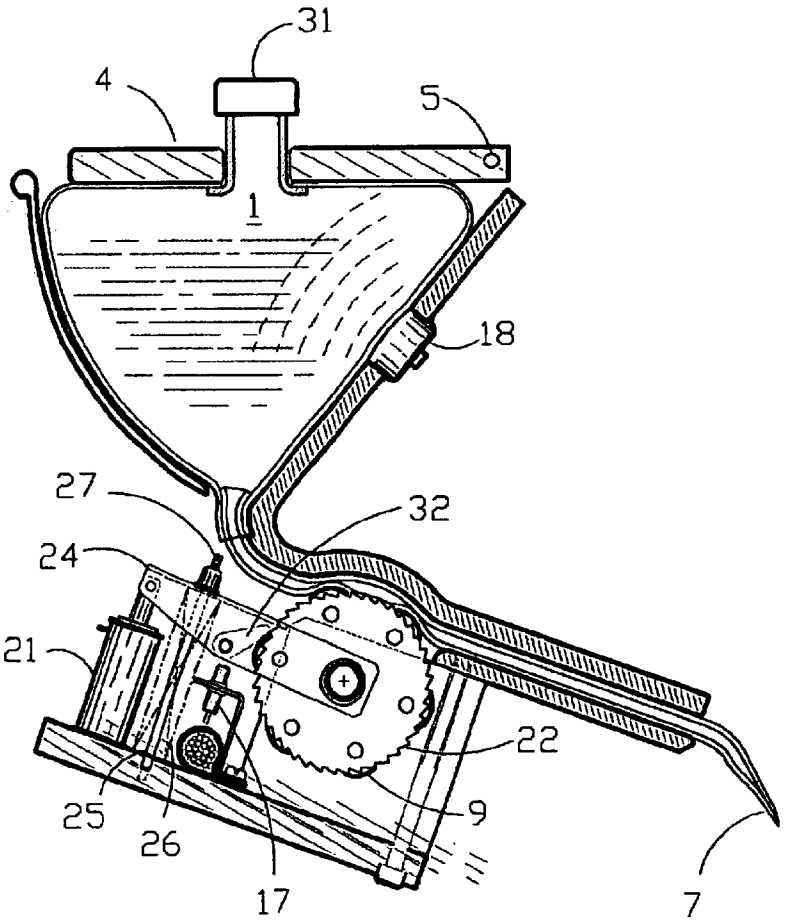
FIG. 9 is a sectional view of FIG. 8 with rotary peristaltic pump being driven by a solenoid and ratchet; the solenoid is shown de-energized.

FIG. 9 is a sectional view of the alternate embodiment illustrated in FIG. 8, that more fully illustrates this arrangement. Rollers 23 are supported and moved in a rotary path by a ratchet 22 which is caused to incrementally rotate in clockwise direction by a pawl 32 rotatably supported on driven lever 24, said lever being operatively rotated through a fixed angular excursion in a clockwise direction by spring 25, and in a counterclockwise direction by operative device 21. The stop screws 26 with adjusting nuts 27 limit the clockwise movement of levers 24 and also may used to provide a temporary emergency mechanical means to control the flow ink in case of some types of computer control failure-modes. If the system is configured to use a solenoid as operative device 21, the rotational velocity of the clockwise motion of lever 24 may be controlled by only partially energizing said solenoid with a reduced voltage, thereby partially opposing the force of said spring 25, and reducing the angular velocity of said lever.

If the system is configured to use a pneumatic cylinder as operative means 21, restricting the air flow exiting from the rod end of said cylinder can similarly reduce the rotational velocity of said lever. Reducing the rotational velocity of lever 24 will reduce the velocity of all the oscillating and rotating components, thereby reducing the rate at which said liquid is dispensed, allowing the interval of time during which the liquid is being dispensed to approximate the interval between control pulses, thereby enabling the control means to regulate the rate of dispensing such that the dispensed volume is substantially uniform over time. To optionally provide this more uniform flow of liquid, sensor 39 signals the control system that lever 24 has moved through a predetermined portion of its total stroke; the control system notes the time interval from the de-energizing of the solenoid until a signal is received. Said computer control records the time interval to rotate through a given distance obtained on prior cycles, providing predictive information to optimize and control the velocity of said lever to provide a uniform flow of ink to the press.

FIG. 10 shows a cross section of alternate embodiment FIG. 8 similar to FIG. 9 except that operative device 21 is retracted down, and lever 24 is in its maximum counterclockwise position. Reservoir 1 is shown in a partially depleted condition and pressure plate 4 has moved counterclockwise about pivot 5 to maintain pressure in said reservoir.

Figure 11:
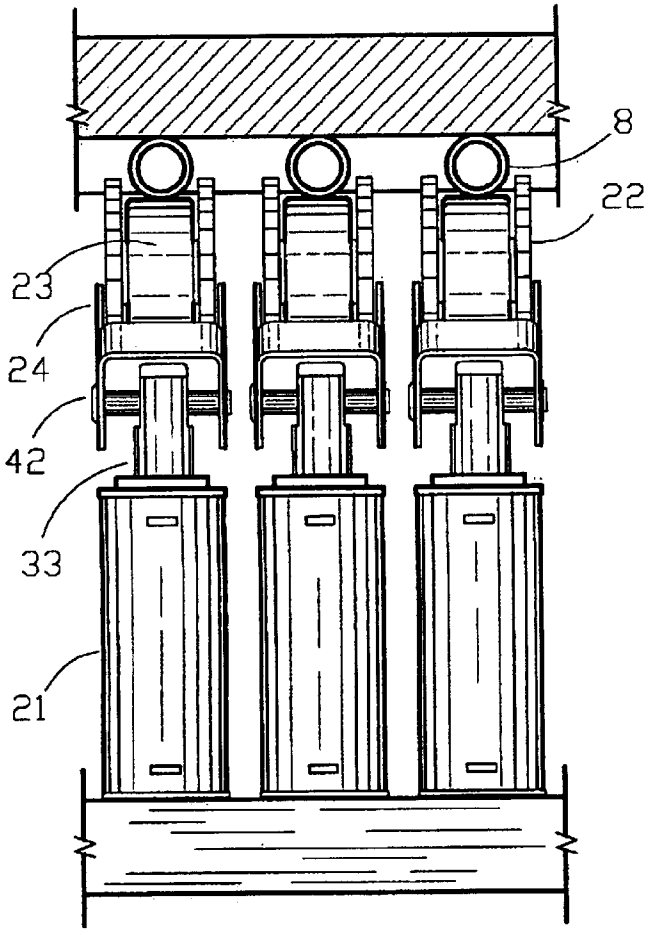
FIG. 11 is a rear view of several of the solenoids and associated mechanisms of FIG. 8.

FIG. 11 shows a left view of three of the peristaltic pumps wherein the operative means 21 which drives the ratchet is shown as a solenoid. The solenoid pulls plunger 33 connected to lever 24 by pin 41, causing the lever to rotate. The actual number of ratchet-pump assemblies is dependent on the width of the particular press. Roller 23 supported on axle 36 which presses together opposing walls of tubing 7, forming said tubing into an oboval shape and sealing flow through the tube past the pinch-point. Ratchet 22 is supported by a bearing and unidirectional clutch 37 which rotates about common shaft 34 supporting the plurality of pump roller assemblies.

Figure 12:
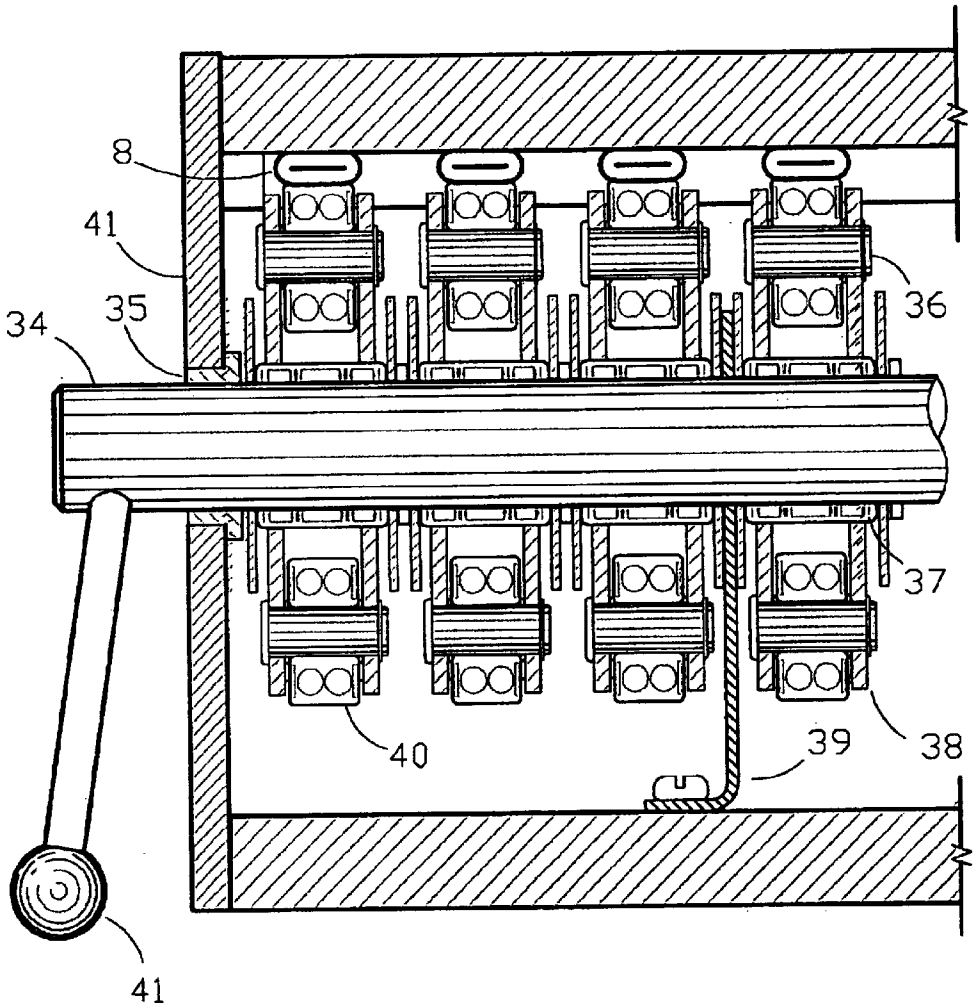
FIG. 12 is a sectional view through the roller shaft showing the rollers compressing the tubes, the roller clutches, and the manual feed lever.

FIG. 12 shows a cross-sectional view of FIG. 8 through the shaft 34, said shaft being rotationally supported by bearings 35 pressed into a bracket 31 at each end, and by intermediate brackets 29, said brackets being spaced throughout the length of said shaft. Lever 29 at each end provides a manual override, allowing the press operator to manually supply ink over the entire width of the press at the beginning of a press run by rotating shaft 34, engaging unidirectional clutch 37 and thereby overriding the ratchet mechanism and directly driving rollers 30.

Figure 13:
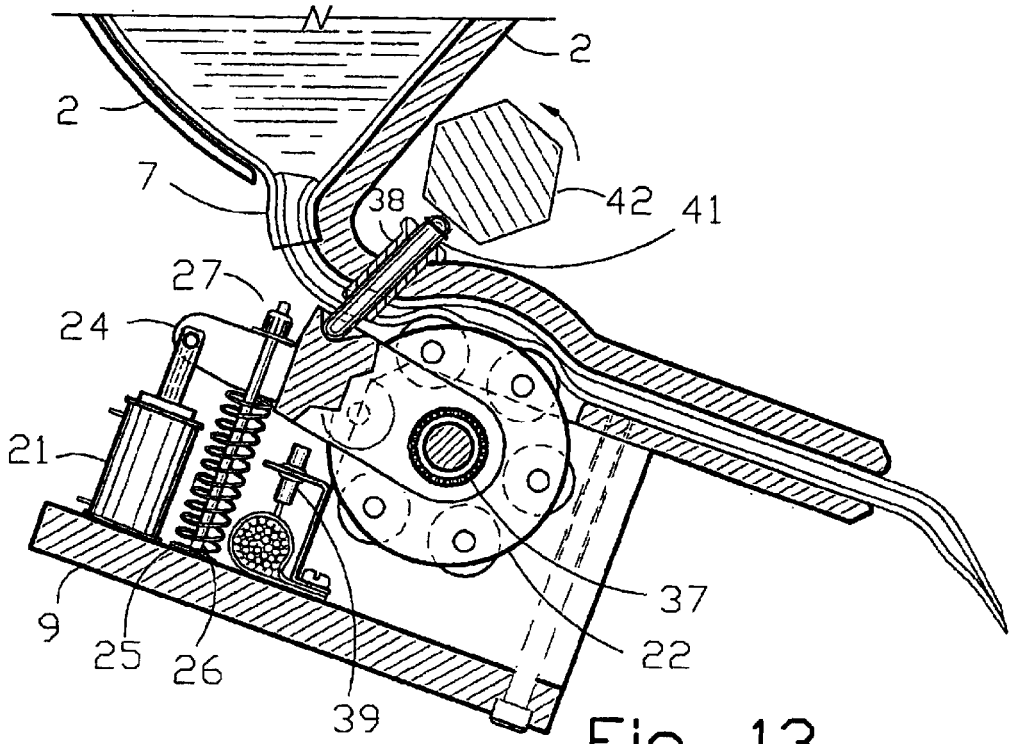
FIG. 13 is a rear sectional view of yet another embodiment of the present invention showing a press, driven rotary peristaltic pump driven by a ratchet, at the end of its maximum feed stroke.
Figure 14:
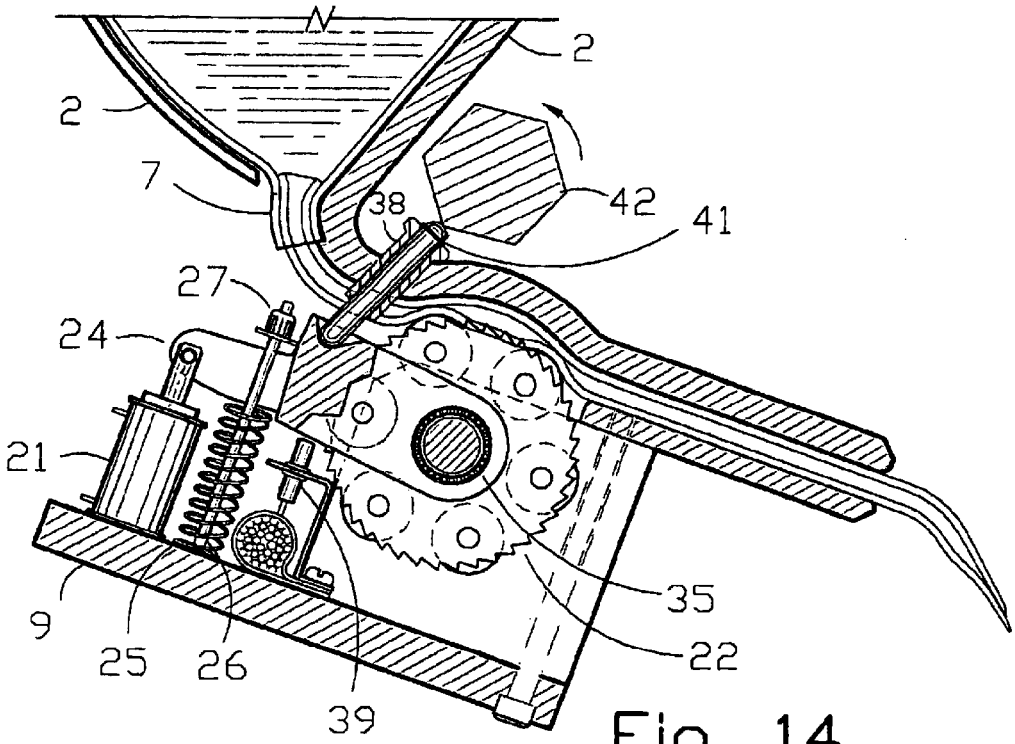
FIG. 14 is a view of FIG. 13 showing the press driven rotary peristaltic pump at the beginning of its feed stroke using a unidirectional clutch instead of a ratchet.

FIG. 13 shows yet another embodiment wherein a hexagonal cam 42 driven at either a fixed or variable ratio to the web speed, provides a rotary oscillation to lever 24 through cam-follower pin 41 which drives the peristaltic pump through either a unidirectional clutch as shown in FIG. 13, or a ratchet as shown in FIG. 14.

FIG. 14 shows the pin at the hexagonal cam lobe. To reduce the liquid volume from the maximum, an operative means, such as solenoid 21 is actuated when the cam is at this peak position, and then deactivated at between 30 deg. and 60 deg. of angular rotation later to dispense an amount between minimum and maximum will be dispensed, an earlier release by operative means 21 providing a greater amount to be dispensed as opposed to a later release. If the operative activated continuously, there will be no pumping action, and the lever 24 will remain in the position shown in FIG. 14. Cam 42 is most simply and economically driven by a gear engaging the gear-train of the printing press. Other mechanical means may be used to vary the displacement of lever 24, including operative means to engage and disengage the pawl 32. An electronic speed controlled motor to drive the cam provides for greater control sophistication, but at additional cost;

What is claimed is:

1. A system for metering viscous liquid coatings onto a circumferential surface of a rotating roller having a velocity essentially equal to a surface velocity of the item being printed, comprised of:

a bag-shaped liquid coating reservoir comprising elastomeric-film walls, a bottom wall of said liquid coating reservoir having attached thereto a plurality of elastormeric tubing sections each of which penetrate the bottom wall of said liquid coating reservoir, where the exterior surface of the first ends of said elastomeric tubing sections are sealed liquid tight to said bottom wall, said elastomeric tubing sections extending through, and providing the elastormeric tubular element of a plurality of peristaltic liquid coating metering pumps, each controlling a flow rate and a thickness of one of a series of contiguous bands of liquid coating across the circumferential surface of said rotating roller and wherein said peristaltic liquid coating metering pumps are comprised of a plurality of rollers sequentially and progressively pressing and rolling against said elastomeric tubing sections, thereby temporarily collapsing a length of the tubing walls, the progressing collapsed length causing liquid contained in the tubes to travel away from said liquid coating reservoir as the rollers progress along said tubes, said rollers being caused to progress along said tubes by an oscillating lever connected by a unidirectional coupling means to a frame supporting said plurality of rollers, said flow rate from said peristaltic liquid coating metering pumps being varied by a signal from a computer control means which limits the rotary motion of said oscillating fevers, and wherein the second ends of said elastomeric tubing sections are formed into a flared and flattened closed shaped orifice not permanently sealed together, to prevent retrograde motion of the liquid coating contained therein, and to provide a closure when not dispensing to prevent dripping of said liquid coating, and to prevent entrance of air and contaminants into said orifice, and to provide variable apertures on the second end proportional to a pressure of said liquid coatings flowing through said elastomeric tubes, wherein said pressure bends apart the flared and flattened end surfaces of said second ends a vertical distance proportional to said pressure, thereby dispensing a flat ribbon of said liquid onto said rotating roller in a sequence of contiguous bands of coating regardless of the flow rate, and wherein one of the flattened surfaces of said second end is urged into contact with said rotating roller.

2. The system for metering viscous liquid coatings of claim 1 wherein said elastomeric-film liquid coating reservoir is enclosed in a rigid container having a lid so disposed as to forcibly pivot down on the top of said elastomeric reservoir, thereby equally pressurizing the liquid supplied to each peristaltic metering pump, wherein part of the peristaltic metering pump may be pivoted open to facilitate loading and unloading of said elastomeric-film liquid coaling reservoir.

3. The system for metering viscous liquid coatings of claim 1 wherein each of said peristaltic metering pumps is driven in a stepwise manner by a spring force acting in opposition to the force of a solenoid, said solenoid being energized by said computer control means which is programmed to supply a regulated voltage supply to said solenoid to selectively partially energize said solenoid acting in opposition to said spring force, whereby a net force which operates said peristaltic metering pump is responsive to a time interval between strokes, whereby said liquid is dispensed in a virtually continuous stream.

4. The system for metering viscous liquid coatings of claim 1 wherein each of said peristaltic metering pumps is unidirectionally rotated by its attached ratchet wheel, said ratchet wheel being driven rotationally by a pawl mounted on a ratchet lever which is caused to reciprocate by one of a plurality of rotating cam mechanisms driven at a speed proportional to the speed of the item to be coated, a solenoid being provided to intercept said ratchet lever, whereby the amount of said viscous liquid coating dispensed is determined by the time position relation to the rotation of said cam mechanism at which the motion of said ratchet lever is intercepted.

5. The system for metering viscous liquids of claim 1 wherein said plurality of peristaltic metering pumps are operated by a linear metering system comprising a pneumatic cylinder, a cylinder rod end, a frame, an elastomeric tube segment, a wheel bracket and a pivoting roller which selectively presses against said elastomeric tube segment, said pivoting roller and said wheel bracket pivots on the cylinder rod end in such a manner that said wheel rotatably mounted in a pivoting bracket pressing against said frame thereby positioning said pivoting bracket to forcibly press said roller mounted thereon against said tube segment on the forward stroke of the pneumatic cylinder, thereby forcing the liquid contained therein to flow along inside the tube with the roller pressure being released on the backward stroke by pivoting of said wheel bracket, said pneumatic cylinder motion being controlled by said computer control means which provides a regulated pneumatic signal to move said cylinder at a forward speed such that the liquid is dispensed in an essentially continuous stream, and with a rapid return stroke.

6. The system for metering viscous liquids of claim 1 wherein the liquid coating being dispensed is offset printing ink and the roller onto which the ink is being dispensed is included in the inking roller arrangement of an offset printing press, wherein the item to be printed consist of paper sheets or a web of paper which is being printed upon.

* * * * *